US006776712B2

(12) United States Patent
Idaka

(10) Patent No.: US 6,776,712 B2
(45) Date of Patent: Aug. 17, 2004

(54) GAME MACHINE AND METHOD OF PERFORMING GAME EXECUTED THEREIN

(75) Inventor: Mitsuhira Idaka, Tokyo (JP)

(73) Assignee: Konami Corporation, Tokyo (JP)

( * ) Notice: Subject to any disclaimer, the term of this patent is extended or adjusted under 35 U.S.C. 154(b) by 0 days.

(21) Appl. No.: 09/961,269

(22) Filed: Sep. 25, 2001

(65) Prior Publication Data

US 2002/0037763 A1 Mar. 28, 2002

(30) Foreign Application Priority Data

Sep. 25, 2000 (JP) ..... P.2000-289985

(51) Int. Cl.[7] ..... A63F 9/24
(52) U.S. Cl. ..... 463/16; 463/25
(58) Field of Search ..... 463/12–13, 16–17, 463/20–22, 25, 30–31, 37, 42; 273/236, 292, 274

(56) References Cited

U.S. PATENT DOCUMENTS 3,810,627 A * 5/1974 Levy ..... 463/26
5,393,067 A * 2/1995 Paulsen et al. ..... 273/292
5,718,430 A * 2/1998 Aramapakul et al. ..... 273/292
5,879,007 A * 3/1999 Kasri ..... 273/292
6,056,641 A * 5/2000 Webb ..... 463/13
6,293,864 B1 * 9/2001 Romero ..... 463/12

OTHER PUBLICATIONS

"Play Cards, How to Play , How to Win" 8th Edition, pp. 73–75 (Gotou Shoin, Aug., 1987), Encyclopedia of Casino Game for Beginners reprinted (IK.K. Tokyo–dou Shuppan, May 20, 1998).

* cited by examiner

*Primary Examiner*—Kim Nguyen
(74) *Attorney, Agent, or Firm*—Sughrue Mion, PLLC

(57) ABSTRACT

When a user desires to participate a roulette game performed in a game machine, the user participates himself in the game by use of a station of the game machine. Of the users, a user who has declared to be an owner can participate and play the roulette game as the owner. In contrast, a user who has participated the game as a player predict a number determined by a roulette wheel and bet chips. If no winning chips have hit, the chips betted in a layout table are paid to the owner. In contrast, if winning chips have hit, the amount of payout is computed, and the chips are paid to the player. If the amount of chips paid to the player is greater than the amount of chips betted in the layout table, chips are paid to the players from the chips possessed by the owner.

19 Claims, 7 Drawing Sheets

GAME MACHINE AND METHOD OF PERFORMING GAME EXECUTED THEREIN

BACKGROUND OF THE INVENTION

The present invention relates to a game machine, which is installed in an amusement arcade or the like, for performing a game in which a game value is transferred between an owner and at least one player. Specifically, the present invention relates to a game machine and a method of performing a game executed therein, which allows game participants to enter the game effected by the game machine as players by accepting predetermined game values from the game participants and which pay, to players, game values corresponding to an amount of game values accepted from the players when the players have satisfied predetermined requirements in the game.

There has hitherto been employed a game machine which artificially reproduces a gambling game to be performed in a casino, such as roulette or blackjack, by executing a suitable computer program. For instance, there are mentioned a roulette game machine and a blackjack game machine, which are installed in an amusement arcade. In connection with the roulette game machine, a game participant; that is, a player, predicts the number that will come up on the roulette wheel and bets on the predicted number a gaming token or chip (i.e., a game value) possessed by the player. If the thus-betted number has hit, the player can receive a predetermined number of gaming tokens from the owner; i.e., the owner. In connection with the blackjack game machine, a game participant acts as a player and plays a match with the owner. When having won the match, the player can receive a predetermined number of gaming tokens from the owner.

In such a roulette game machine, the game participant can hitherto enter a game only as a player. In addition to the roulette game machine and the blackjack game machine, a poker game machine or the like has also been known. However, such a game machine also enables a game participant to enter a game only as a player.

SUMMARY OF THE INVENTION

It is therefore an object of the present invention to provide a game machine and a game performing method, which can provide a new entertainment value to game participants by adding a new game element to a game, wherein game values are transferred between the owner and players.

In order to achieve the above object, according to the present invention, there is provided a game machine, comprising:

- a game executer, which executes a game in which game values are transferred between an owner and at least one player;
- an entry authorizer, which receives a first amount of game values and a player-payout requirement used in the game, from a game participant who wants to be authorized to entry the game as a player;
- a player-payout requirement determinant, which judges whether the authorized player satisfies the player-payout requirement;
- a player-payout performer, which pays out a second amount of game values to the player who satisfies the player-payout requirement, the second amount of game values being determined in accordance with the first amount of game values and the player-payout requirement;

- an owner determinant, which determines an owner from the game participants in accordance with a predetermined owner requirement; and
- an owner-payout performer, which pays out at least a part of a third amount of game values to the owner, in accordance with the predetermined owner-payout requirement, the third amount of game values being a total amount of the game values received by the entry authorizer.

In this configuration, a new game element; that is, the ability to enable entry of a user as the owner, is added to a game which involves the transfer of game values between the owner and players. There is yielded an advantage of ability to provide new game entertainment value to game participants.

In the game machine, the owner requirement may includes issuance of an owner entry request stating that a participant desires to participate as the owner and the amount of game values possessed by a participant.

Depending on the aspect or status of the game, various player-payout requirements are conceivable. For instance, in the case of a roulette game, the player-payout requirements correspond to occurrence of a match between numbers where tokens serving as the game values are bet and numbers determined by the roulette wheel. In the case of a blackjack game, hands of respective players to receive payouts must be closer to the number 21 than is the hand of a dealer.

Depending on the aspect or status of the game, various methods are conceivable as payout methods to be employed by the player-payout performer. For instance, there are conceived a method of paying game values from all the game values accepted in the game; a method of paying game values from the game values possessed by the owner; and a method of paying game values from the game values accumulated in the game machine.

Depending on the aspect or status of a game, various methods are conceivable as payout methods to be employed by the owner-payout performer. The payout method is determined in association with the payout method employed by the player-payout performer. For example, when a method of paying game values from the game values possessed by the owner is employed as a payout method, there may also be employed a method of paying to the owner all game values accepted from players.

Preferably, the owner-payout performer pays to the owner a part of a rest amount of game values obtained by subtracting a fourth amount of game values from the third amount of game values. The fourth amount game values is a total amount of the game values paid by the player-payout performer.

In this configuration, with a larger amount of game values received from the player and a smaller amount of game values paid to the player, the owner can receive a larger amount of game values. Particularly, when no player satisfies the player-payout requirements and no payout is performed, the owner can acquire all accepted game values. Thus, there can be developed a game in which the owner can expect high returns. Therefore, there is an advantage of ability to provide a higher degree of game entertainment.

Preferably, the player-payout performer pays out the second amount of game values from the third amount of game values.

In this configuration, a game can proceed such that the player and the owner attempt to acquire all the game values received from the player. Therefore, there is an advantage of ability to provide a higher degree of game entertainment to both of the player and the owner.

Here, it is preferable that the game machine further comprises an overpayment determinant which judges the fourth amount of game values exceeds the third amount of game values. The player-payout performer pays out an excess amount of game values from game values possessed by the owner, when the overpayment determinant judges the fourth amount of game values exceeds the third amount of game values.

In this configuration, when the total amount of game values to be paid to the player who satisfies the player-payout requirement has exceeded the total amount of game values received, the owner must pay, from his own game values, game values corresponding to an excess. Hence, a game participant who has become the owner can expect high returns with higher risks. Therefore, there is an advantage of ability to provide a higher degree of game entertainment to the participant acting as the owner.

Alternatively, the player-payout performer pays out the second amount of game values from game values possessed by the owner.

In this configuration, although the owner involves high risk, a confrontation between the player and the owner becomes definite. Therefore, there is an advantage of ability to provide a higher degree of game entertainment to both of the player and the owner.

In the above cases, it is preferable that the game machine further comprises a bonus presenter, which presents bonus game values to the player, when the excess amount of game values exceeds the game values possessed by the owner.

In this configuration, in addition to an objective of game, such as satisfying the player-payout requirement during the game, the player is provided with a bonus awarded when the owner has gone bankrupt. Hence, there is an advantage of ability to provide a higher degree of game entertainment to the player.

Preferably, the game machine further comprises an acceptance amount limiter, which delimits an upper limit of the first amount of game values in accordance with a predetermined acceptance requirement.

In this configuration, an upper limit of the second amount of game values can be delimited. By limiting the second amount of game values, the amount of game values paid from the game values possessed by the owner is limited. Thus, the owner can be imparted with certain protection by setting predetermined reception requirement, as required. Depending on the aspect or status of a game, various receipt requirements are conceivable. For instance, a requirement for preventing the maximum amount of game values to be paid by the owner from exceeding the amount of game values possessed by the owner.

Here, it is preferable that the game machine further comprises an upper-limit information receiver, which receives an upper limit information issued from the owner for determining the upper limit of the first amount of game values. The acceptance amount limiter utilizes the upper limit information as the acceptance requirement.

In this configuration, the upper limit of the amount of game values accepted from players can be limited on the basis of the owner's wishes. For instance, if the owner desires low returns with low risks, the upper-limit information may be set such that the maximum amount of game values paid by the owner does not exceed a portion of the amount of game values possessed by the owner. In contrast, if the owner desires high returns with high risks, the upper-limit information can be set such that the maximum amount of game values paid by the owner exceeds the amount of game values possessed by the owner. Hence, there is an advantage of ability to control the game, which is entertainment unique to the owner. There is also an advantage of ability to enable the owner to control risks.

Preferably, the game machine further comprises an owner entry request receiver, which receives an owner entry request issued from a game participant who wants to participate in the game as an owner. The owner determinant determines the owner from at least one game participants who has issued the owner entry request.

In this configuration, it is possible to enable a game participants who wishes to be the owner to participate as the owner at his own will. If the number of game participants who desire to act as the owner is greater than a predetermined number, the owner may be determined from the game participants in accordance with a predetermined owner requirement.

Preferably, the owner requirement is that a participant who wants to participate the game as an owner has game values not less than a predetermined amount.

In this configuration, such a requirement poses a limitation on game participants who can become the owner, thereby enhancing the value of becoming the owner. Further, when game values are paid to the player from the owner, progress in a game may be hindered if the owner does not have a certain amount of game values. Even in such a case, the above-described requirement enable smooth progress in a game.

Preferably, the game machine further comprises:

an acceptance termination request receiver, which receives an acceptance termination request from the owner to terminate a period in which the entry authorizer receives the game values from the player; and an acceptance refuser, which refuses to receive the game values from the player, when the acceptance termination request receiver receives the acceptance termination request.

In this configuration, the owner can control a progress in game by advancing or delaying progress of a game. There is an advantage of the ability to enable a game participant who has become the owner to enjoy entertainment, such as operation of progress of a game, which is unique to the owner and differs from that of the player.

According to the present invention, there is also provided a method of performing a game in which game values are transferred between an owner and at least one player, comprising the steps of:

a) inputting a player entry request to a game machine in which the game is executed, the player entry request being issued from a game participant who wants to participate in the game as a player;

b) determining an owner from the game participants in accordance with a predetermined owner requirement;

c) receiving a first amount of game values and a player-payout requirement used in the game from the game participant who has issued the player entry request;

d) executing the game while involving the player participated in the step a) and the owner determined in the step b);

e) judging whether the player satisfies the player-payout requirement, after the step e) is finished;

f) paying out a second amount of game values to the player who satisfies the player-payout requirement, the second amount of game values being determined in accordance with the first amount of game values and the player-payout requirement; and g) paying out at least a part of a total amount of the first game values received in the step c) to the owner, in accordance with a predetermined owner-payout requirement.

Here, the expression "game values" means gaming tokens or coins which are gained or lost in accordance with a game result and used in an amusement arcade. When a roulette game is played through use of the game machine according to the present invention, chips or electronic data employed in the roulette game also correspond to game values.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCIPTION OF THE PREFERRED EMBODIMENTS

There will now be described an embodiment, wherein the present invention is applied to a game machine for effecting a roulette game.

The overall configuration of a game machine according to the present embodiment will first be described.

Figure 2:
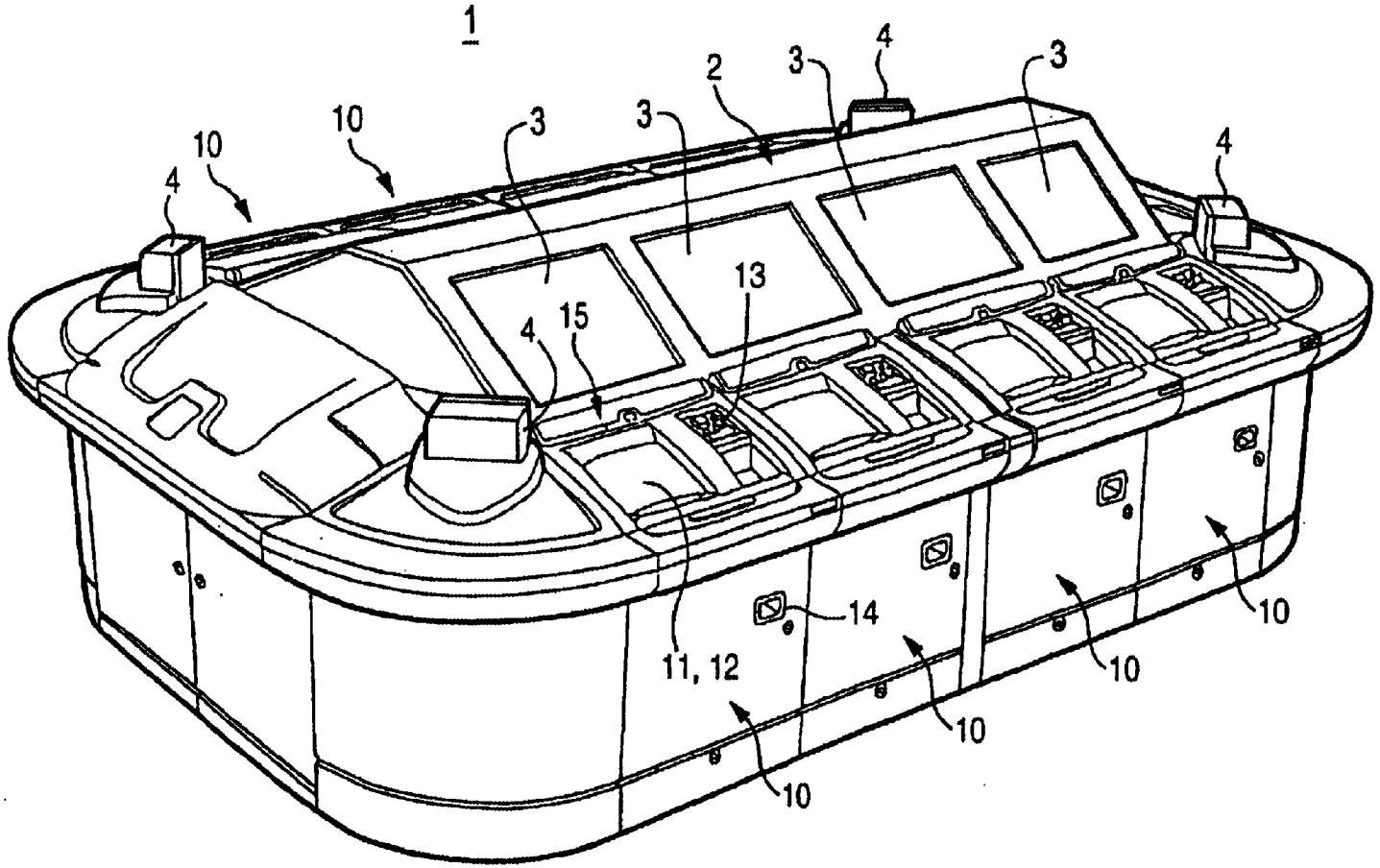
FIG. 2 is an external view showing the entirety of the game machine.

FIG. 2 is an external view showing the entirety of a game machine according to the embodiment. The game machine 1 comprises a center monitor 2 located at the center, and a plurality of stations 10 located so as to surround the center monitor 2. The center monitor 2 has center displays 3 assigned to the respective stations 10. A gaming status, such as an image of a roulette, appears on the center display 3. A plurality of speakers 4 are disposed around the center monitor 2 for outputting sound for augmenting a game, the sound of a wheel, and the voice of the dealer.

Each of the stations 10 comprises a user display 11 for a game participant (i.e., a user) which displays a game screen in accordance with a progress in game; and a touch panel 12 laminated on a display surface of the user display 11. When the user touches a predetermined position on the game screen appearing on the user display 11 in accordance with an instruction on the game screen, a touched position is detected by the touch panel 12. The game machine 1 then ascertains an operation performed by the user. The station 10 is provided with a token insertion slot 13 into which the user inserts gaming tokens serving as game values; and a token payout port 14 by way of which gaming tokens are paid to a player.

In principle, the game machine 1 develops a game analogous to that effected in a real roulette game, in accordance with a game execution program to be described later. More specifically, the user acts as a player and bets chips: that is, electronic data into which the inserted gaming tokens are converted in accordance with the number of tokens, to a slot(s) through operation of the touch panel 12. The electronic data pertaining to chips are recorded in RAM 205 of the station 10, which will be described later. In accordance with the game execution program, the wheel starts spinning and then determines one winning number. Chips corresponding to the amount of bets are paid to players who have satisfied a player-payout requirement that chips are betted on slots associated with the number. When the user leaves the game, the user can receive tokens into which the electronic chip data recorded in the RAM 205 are converted, by way of the token payout port 14.

Figure 3:
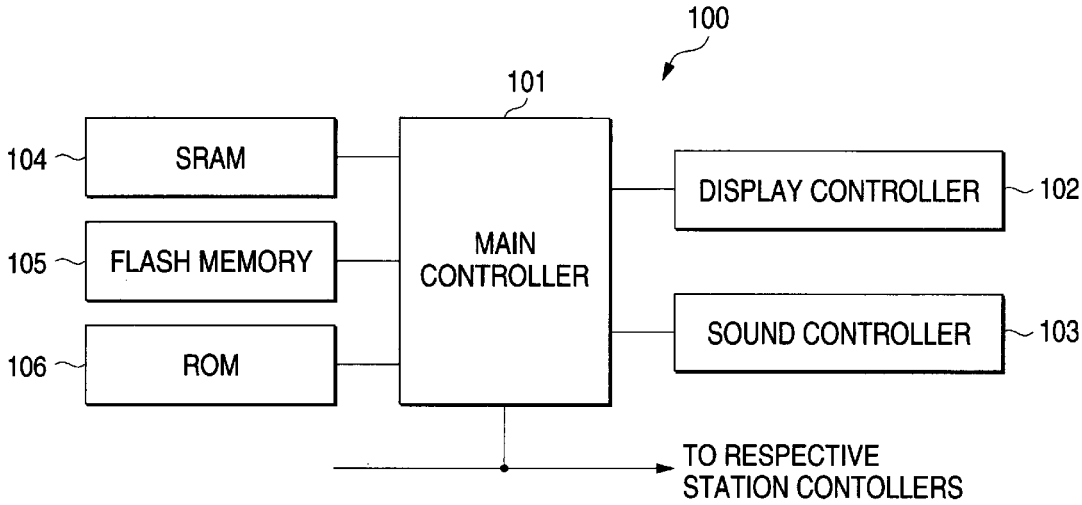
FIG. 3 is a block diagram showing a main control section of the game machine.
Figure 4:
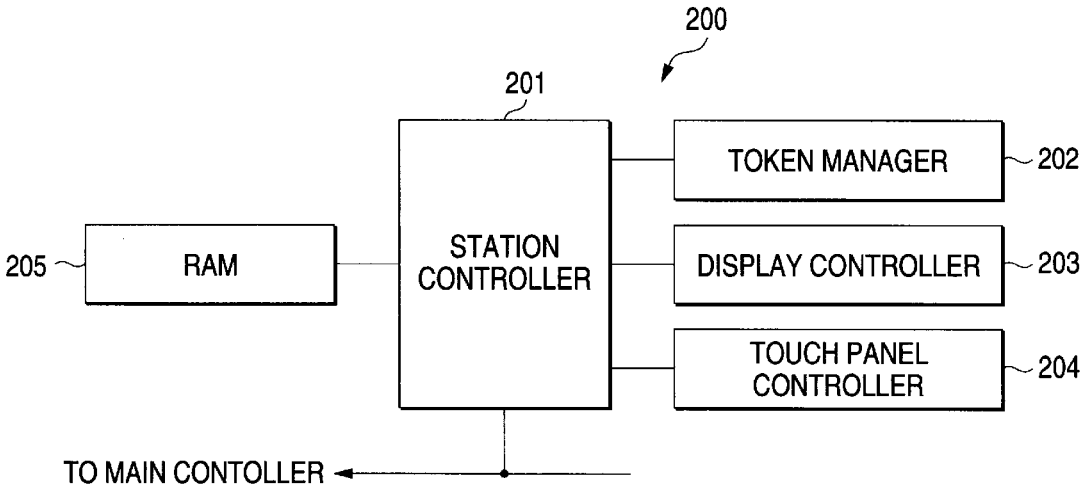
FIG. 4 is a block diagram showing a station control section of the game machine.

FIG. 3 is a control block diagram showing a main control section 100 for integrally controlling operation of the game machine 1. FIG. 4 is a control block diagram showing a station controller provided for each of the stations 10.

As shown in FIG. 3, a main control section 100 provided in the center monitor 2 comprises a main controller 101; a display controller 102 for controlling display of images on the center display 3 of the center monitor 2; a sound controller 103 for controlling a sound or voice to be output from the speakers 5; an SRAM 104 and a flash memory 105 for recording various data sets; and a ROM 106 for storing programs and databases required for effecting a game. The main controller 101 is connected to the display controller 102, the sound controller 103, the SRAM 104, the flash memory 105, and the ROM 106. The ROM 106 stores a database, such as an odds table and a roulette probability table. The odds table describes a correlation between slots on which players have placed bets in association with the number determined by the roulette and corresponding odds. The roulette probability table describes a correlation between 38 numbers prepared for determining a winning number and the probability of occurrence of the number.

As shown in FIG. 4, a station control section 200 provided in each of the stations 10 comprises a station controller 201; a token manager 202 for managing payment of gaming tokens; a display controller 203 for controlling display of images on the user display 11; a touch panel controller 204 which receives a signal from the touch panel 12 and converts the thus-received signal into a predetermined control signal; and a RAM 205 for temporarily recording various types of data sets, such as chip data, for each user. The station controller 201 is connected to the token manager 202, the display controller 203, the touch panel controller 204, and the RAM 205. The station controller 201 is also connected to an unillustrated token insertion sensor for sensing gaming tokens inserted by way of the token insertion slot 14.

As shown in FIGS. 3 and 4, the station controller 201 provided in each of the stations 10 is connected to the main controller 101 provided in the center monitor 2. Required communication can be established between the station controller 201 and the main controller 101.

Figure 5A:
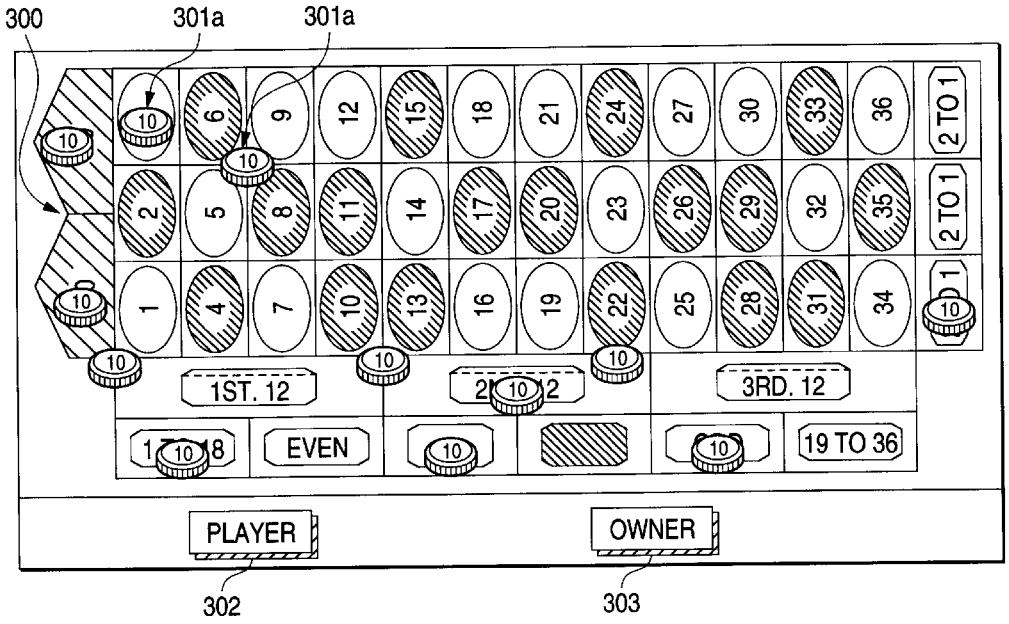
FIGS. 5A and 5B are descriptive views showing a guidance screen appearing on a user display.
Figure 5B:
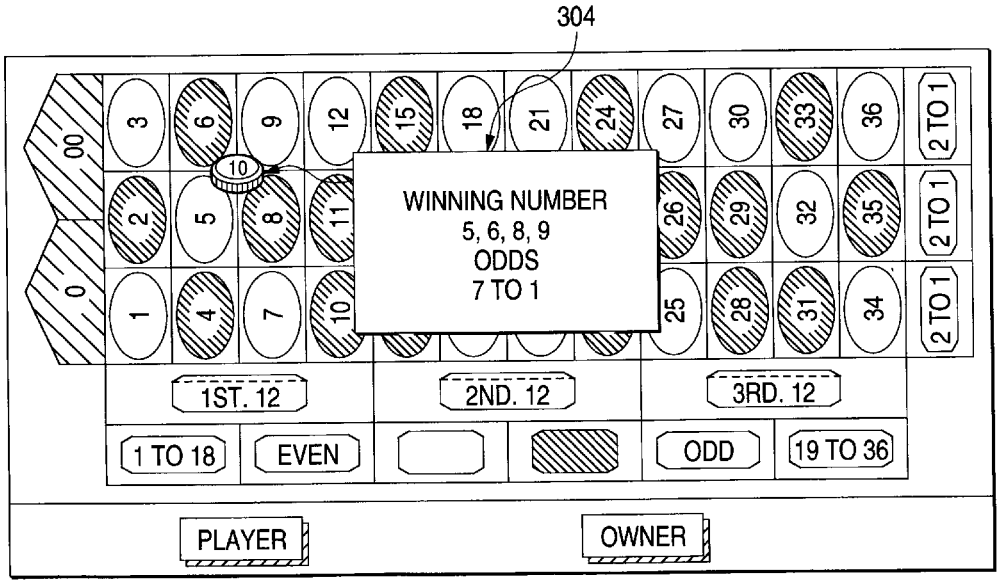

FIG. 5A is a descriptive view showing a guidance screen, which screen appears on each of the user displays 11 for explaining odds of a roulette and slots where a user can place bets. The guidance screen appears on the user displays 11 by the display controller 203 of the station control section 200. On the guidance screen is displayed an image of demonstration chips 301 a placed in areas of a layout table 300 of the roulette on which players can bet chips. For example, when the user touches one of the demonstration chips 301*a*, the touch panel 12 detects that the thus-touched demonstration chip 301*a* has been selected. A touch signal is then sent from the touch panel controller 204 to the station control section 200. On the basis of the touch signal, the station controller 201 sends a predetermined control signal to the display controller 203. The display controller 203 that has received the control signal displays a text box 304 relating to a winning number and odds, such as that shown in FIG. 5B, on the user displays 11.

Figure 6A:
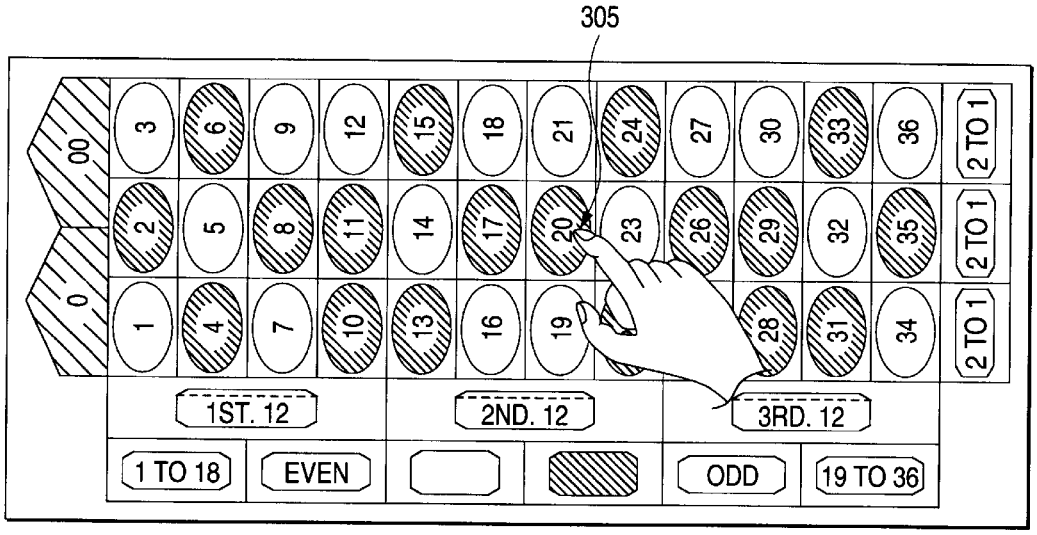
FIGS. 6A and 6B are descriptive views showing a betting screen appearing on a user display.
Figure 6B:
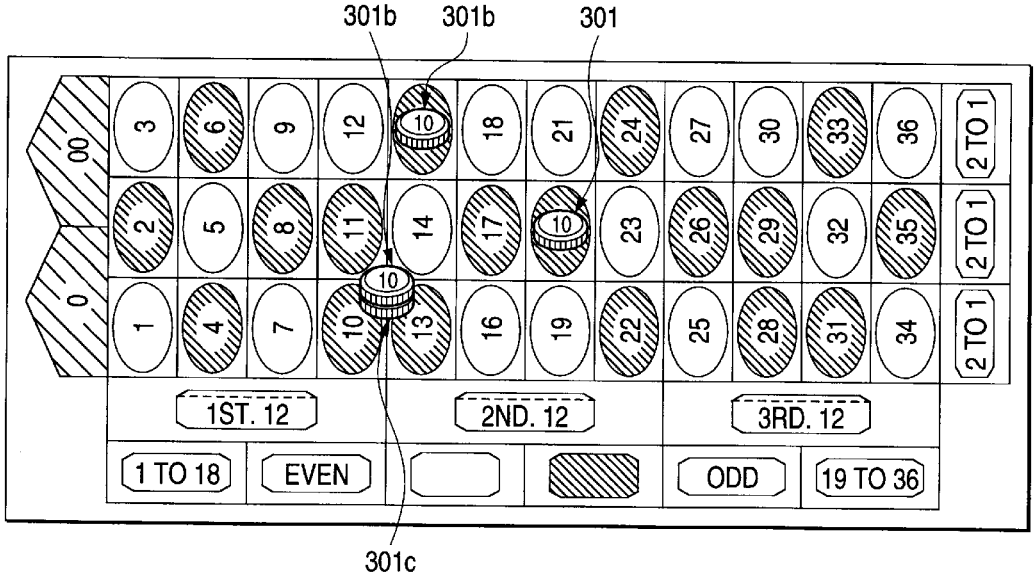

When a user enters a game as a player, the user inserts gaming tokens into the token insertion slot 13 and touches a player button 302 shown in FIG. 5A. As a result, the touch panel controller 204 sends a player entry signal to the station control section 200. The station control section 200 that has received the player entry signal receives betting screen information to be commonly used among the user terminals 10 from the main control section 100. The betting screen information is output to the display controller 203. As a result, a betting screen shown in FIG. 6A appears on the user display 11. When the player touches the number 20 on the betting screen by a finger 305 in the manner as illustrated to perform a single-number betting, a touch signal is sent to the station controller 201 from the touch panel controller 204. As shown in FIG. 6B, the display controller 203 displays the player's chip 301 on the single-number betting of the number 20. The number of chips is incremented every time touching is performed. When the number of chips has exceeded the maximum bet, the chip status returns to a status of no bet. The station controller 201 that has received the touch signal transmits a predetermined control signal to the main controller 101 of the main control section 100. On the basis of the control signal, the main controller 101 instructs the station controllers 201 of other stations 10 participating in the game to update the betting screen appearing on the user displays 11, through use of the display controllers 203. Thus, a common betting screen appears on the user displays 11 of the respective stations 10, whereupon the players ascertain the chips 301*b* and 301*c* betted by the other players, thus grasping the betting status of the entire layout table.

Next will be described a flow of control processing performed by the main controller 101 of the main control section 100, which controller executes a game execution program serving as a game executor.

Figure 1:
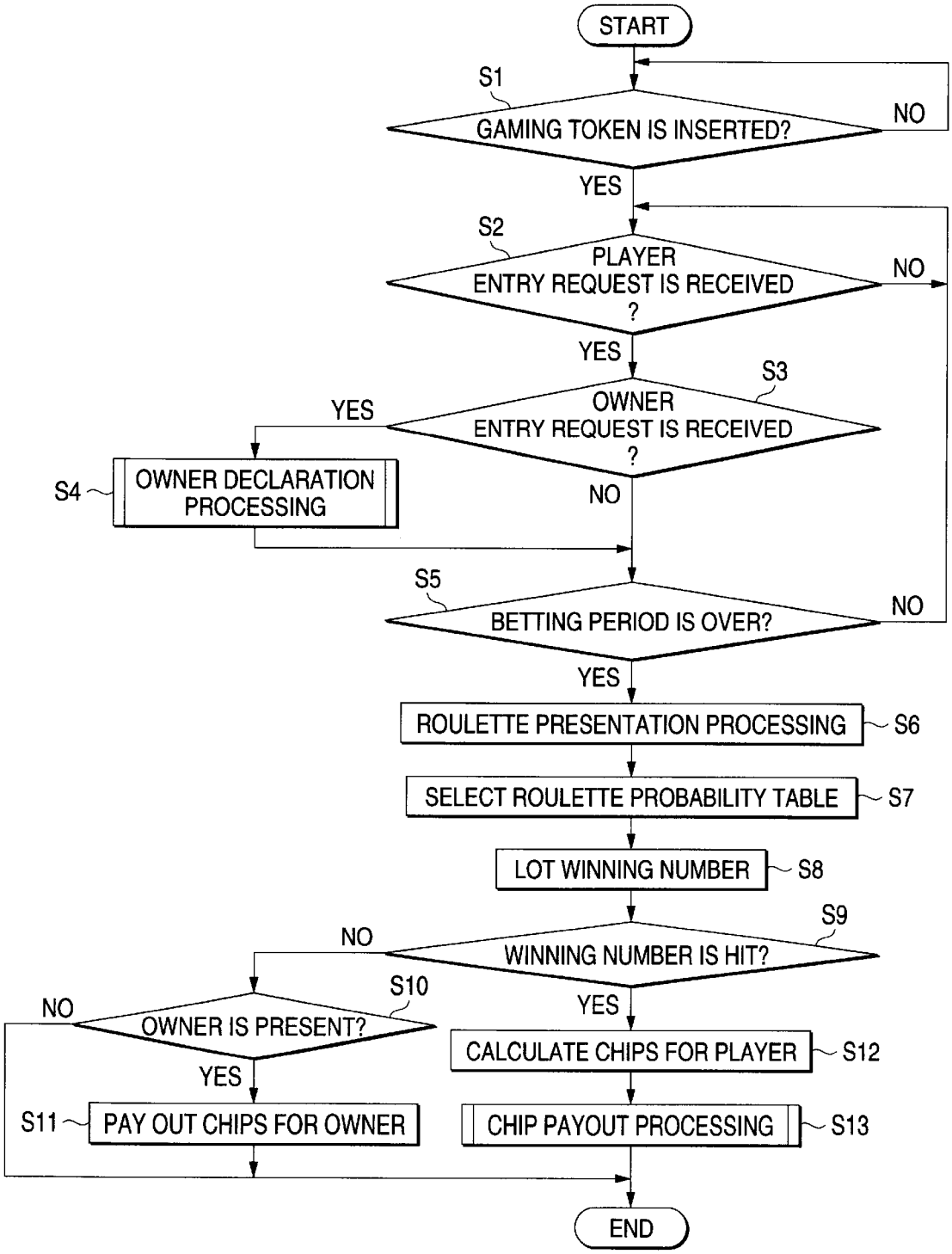
FIG. 1 is a descriptive view showing the flow of roulette game control processing to be effected by a main controller of a game machine according to one embodiment of the invention.

FIG. 1 is a flowchart showing the flow of control processing of the roulette game performed by the main controller 101. When a gaming token is inserted into any one of the stations 10 of the game machine 1, the station controller 201 of the station 10 sends a token insertion signal to the main controller 101. Then, the main controller 101 which performs a game execution program determines that the user has inserted a gaming token (S1). When the gaming token is inserted, chip data corresponding to the number of inserted gaming tokens are recorded on the RAM 205, and the station controller 201 displays the guidance screen shown in FIG. 5A on the user display 11. When the user has touched the player button 302 indicated on the guidance screen, the station controller 201 acting as an entry authorizer allows the user to enter a game as a player. As a result, the betting screen shown in FIG. 6A appears on the user display 11 of the user, thereby enabling the user to bet his chips. Moreover, a player entry signal is sent from the station controller 201 of the station 10 to the main controller 101. By this signal, the main controller 101 which executes the game execution program determines that the player has entered the game (S2). Other users can enter the game in midstream. The game machine 1 according to the present embodiment allows a maximum of eight players to play a game.

When the user who has first entered in the game has touched the player button 302 shown in FIG. 5A, a betting period during which the player can bet is commenced. If the current round of the game is now being played continuously so as to follow the previous round of the game, a betting period is commenced immediately after end of the previous round of the game. During the betting period, the players who have entered the game can bet their chips on areas associated with their predicted numbers, by operating the touch panels 12. When the betting period has elapsed (S5), a betting over signal is output to the station controllers 201 acting as an acceptance refuser in the stations 10 of all the players. As a result, a screen stating that the betting period is finished appears on the user displays 11 of the respective user terminals 10, thereby prohibiting the players from performing betting action by way of the touch panels 12.

During the betting period, the user clicks an owner button 303 on the guidance screen which appears on the touch panel 12 of the station 10 and is shown in FIG. 5A, thereby declaring the owner. As a result, the station controller 201 of the station 10 sends an owner entry request to the main controller 201 acting as an owner entry request receiver. Upon receipt of the owner entry request, the main controller 101 determines that the owner declaration has been effected (S3). When the owner declaration has been effected, the main controller 101 acting as an owner determinant executes owner declaration processing to be described later (S4), thereby determining whether to grant the player the owner.

After lapse of the betting period (S5), the main controller 101 executes roulette presentation processing in accordance with a game execution program (S6). During the roulette presentation processing, presentation images which are to be provided from the time the dealer tosses a spinning ball until the ball falls into the spinning wheel and a winning number is determined, are displayed on the center displays 3 of the center monitor 2. Concurrently, sound and voice associated with the images are output from the speakers 4, thereby enhancing presence.

The main controller 101 that has commenced the roulette presentation processing selects a roulette probability table to be used for the current round of game from among the roulette probability tables recorded in the database ROM 106 (S7). If there is no owner, a roulette probability table which has already been prepared for a game not involving the owner is selected. If the game involves the owner, selection of a roulette probability table is effected on the basis of result of owner declaration processing to be described later. If the roulette probability table has been selected, lotting processing is executed for determining a winning number to appear on the roulette wheel (S8). Through the lotting processing, random numbers for lotting are generated. In light of the selected roulette probability table, one number (winning number) is selected from 38 numbers from 1 through 36, 0, and 00, on the basis of the thus-generated random numbers.

On the basis of the thus-determined winning number, the main controller 101 changes a presentation image appearing on the center displays 3. A presentation change signal is output to the display controller 102. As a result, a presentation image showing that a ball falls into the determined winning number appears on the respective center displays 3, thereby informing the players of the number selected by the roulette wheel.

Once the winning number has been determined through the lotting processing, the main controller 101 acting as a player-payout requirement determinant determines whether or not winning chips are placed on a layout table 300 (S9). If it is determined that no winning chips are placed on the layout table 300, a determination is made as to whether or not the game involves the owner (S10). If it is determined that the owner is involved, the main controller 101 acting as an owner-payout performer performs processing for paying out chips to the owner (S11). During the processing for paying chips to the owner, chips are paid to the owner on the basis of the result of owner declaration processing to be described later. The amount of chips is determined by subtracting an amount of chips corresponding to an entry fee from a total amount of chips (a total amount of accepted chips) betted by the players (subtraction is one of the predetermined requirements for paying out chips to the owner). More specifically, data pertaining to the amount of chips to be paid to the owner are sent to the station controller 201 of the station 10 of the owner, where the data are added to the chip data stored in the RAM 205. If it is determined that there are no winning chips, a no-payout presentation image appears on the center displays 3 of the stations 10 of the players through roulette presentation processing. Further, a no-payout image appears on the user displays 11 of all the players.

If in step S9, it is determined that winning chips are placed in the layout table 300, the main controller 101 performs payout computation processing (S12). Through payout computation processing, winning chips are acknowledged for each player. The amount of payout to be paid to an individual player is computed, through use of the odds table recorded in the ROM 106. Subsequently, the main controller 101 acting as a player-payout performer performs chip payout processing to be described later (S13), thereby paying chips to players or the owner, as required. When chips are paid to players, chip amount data corresponding to the amount of chips to be paid are output from the main controller 101 to the station controllers 201 of the stations 10 of respective winning players. The chip data are added to the chip data stored in the RAM 205 of each of the corresponding stations 10. At this time, a presentation image of a dealer who pays chips to players appears on the user displays 11, and the number of acquired chips are also displayed on the user displays 11. In the meantime a no-payout image display appears on the user displays 11 of the players who have lost.

Next, there will be described the owner declaration processing (S4) to be performed when an owner declaration is effected.

Figure 7:
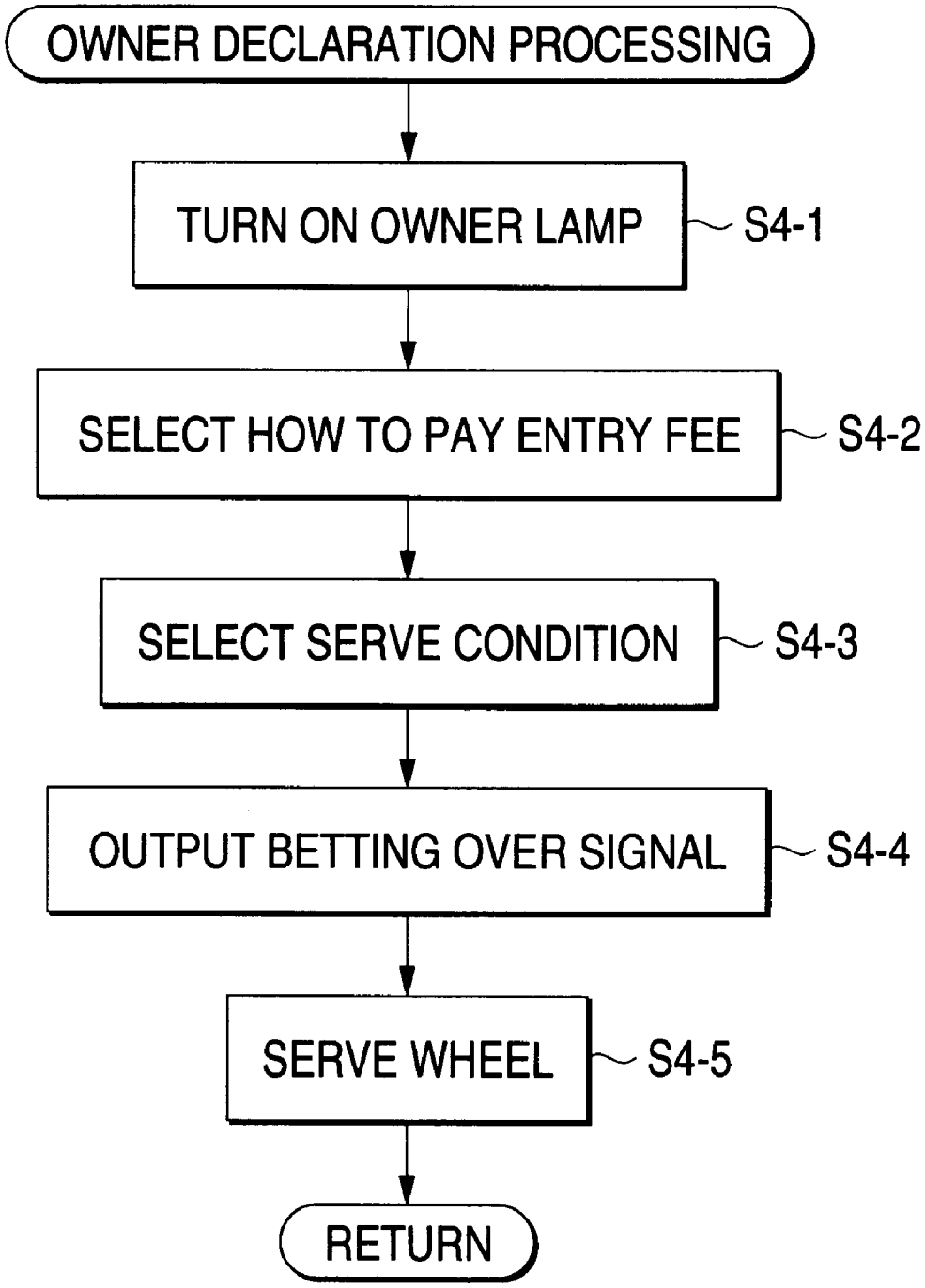
FIG. 7 is a flowchart showing the flow of owner declaration processing performed by the game machine.

FIG. 7 is a flowchart showing the flow of owner declaration processing. In order to act as the owner, a player must touch the owner button 303 displayed on the guidance screen shown in FIG. 5A. The owner button 303 becomes effective only when the station controller 201 acting as the owner determinant has determined that the player has 500 gaming tokens or more, which is a requirement for participating as the owner: more specifically, that chip data corresponding to 500 gaming tokens or more are recorded in the RAM 205 of the station 10. More specifically, only a user having 500 gaming tokens or more are granted a right to participate as the owner. The user earns chips by playing roulette games or adding chips through insertion of purchased gaming tokens, thereby satisfying the requirement for participating as the owner.

When the user granted a right to act as the owner touches the owner button 303, the user is granted to enter the game as the owner. An owner lamp 15 provided in the station 10 of the user is illuminated (S4-1). Then, information stating that the user is to act as the owner is notified to the other users. Further, a predetermined owner declaration screen appears on the user display 11. A betting screen which appears also on the user displays 11 of the players is also displayed. The owner can ascertain the betting statuses of all players.

The owner selects how to pay chips to an amusement arcade while ascertaining the betting statuses of all the players. In the present embodiment, the owner selects either a prepayment for paying chips corresponding to 25 gaming tokens in advance or a deferred payment for paying 10% of a total amount of chips betted in the layout table 300 for the current round of game in which the user is to enter as the owner (S4-2). If a total amount of chips betted in the layout table 300 is large, the user selects the prepayment. In contrast, if the total amount of chips betted in the layout table 300 is small, the user selects a deferred payment. The user can increase profits in accordance with the state of a game.

When the prepayment is selected, chip data corresponding to 25 gaming tokens are subtracted, at this stage, from the chip data pertaining to the user recorded in the RAM 205. During the processing of paying chips to the owner in S11, the total amount of chips betted in the layout table 300 are all paid out to the owner. In contrast, if the deferred payment has been selected, chips determined by subtracting 10% from the total amount of chips betted in the layout table 300 are paid to the owner during the processing for paying chips to the owner in step S11.

When the chip payment of paying chips to an amusement arcade has been selected, a serve condition selection screen to be used for selecting a rotation speed of a roulette wheel and a speed for tossing a ball into the wheel appears on the user display 11 of the owner. The owner operates the touch panel and selects the rotation speed of the wheel and the speed for tossing the ball into the wheel (S4-3), in accordance with the serve condition selection screen. Information about the thus-selected various conditions for tossing action is transmitted to the main controller 101 and utilized as requirements for roulette presentation processing and those for selecting a roulette probability table.

After selection of serve conditions has been completed, an unillustrated betting over screen on which a betting over button for completing a betting period appears on the user display 11. Since a betting screen to be displayed on the user display 11 of the player appears on the screen, the owner touches the betting over button after having ascertained the betting status. A betting over signal serving as betting over request is output to the main controller 101 functioning as an acceptance termination request receiver from the station controller 201 of the owner (S4-4). In step S5 shown in FIG. 1, the main controller 101 acting as the acceptance refuser determines that a betting period has elapsed.

In this way, if the betting period has ended in the manner as mentioned above, an unillustrated serve screen appears on the user display 11 of the owner. On the serve screen are displayed, for example, images such as a dealer's hands moving as if tossing the ball, and a spinning wheel. The owner touches a toss button appearing on the serve screen in accordance with the magnitude of backswing corresponding to a desired strength and the spinning position of the wheel. As a result, a strength for tossing the ball and a timing at which tossing action is to be made can be selected, by a timing at which the owner operates a touch panel. Then, a spinning ball is tossed into the wheel (S4-5). After the spinning ball has been tossed, information about the timing at which the ball has been tossed is sent to the main controller 101, where the information is used as a requirement for selecting roulette presentation processing and a roulette probability table.

When the owner has tossed the spinning ball in the manner mentioned above, a predetermined roulette probability table is selected from among roulette probability tables recorded in the ROM 106, through selection of the roulette probability table in step S7 shown in FIG. 1, in accordance with the rotation speed of the wheel, the tossing speed of the ball, and the timing at which the ball is to be tossed, which have been selected by the owner.

In the present embodiment, there is employed a method of selecting a roulette probability table to be used for a current round of game from among a plurality of roulette probability tables which have been prepared in advance, in accordance with serve requirements. Contents of a roulette probability table may be changed in accordance with the serve condition. Alternatively, the owner is prohibited from selecting the serve condition, and the same roulette probability table may be employed across the board regardless of presence of the owner.

Next will be described chip payout processing (S13) to be performed by the main controller 101 acting as player-payout performer and owner-payout performer when winning chips are present in the layout table 300.

Figure 8:
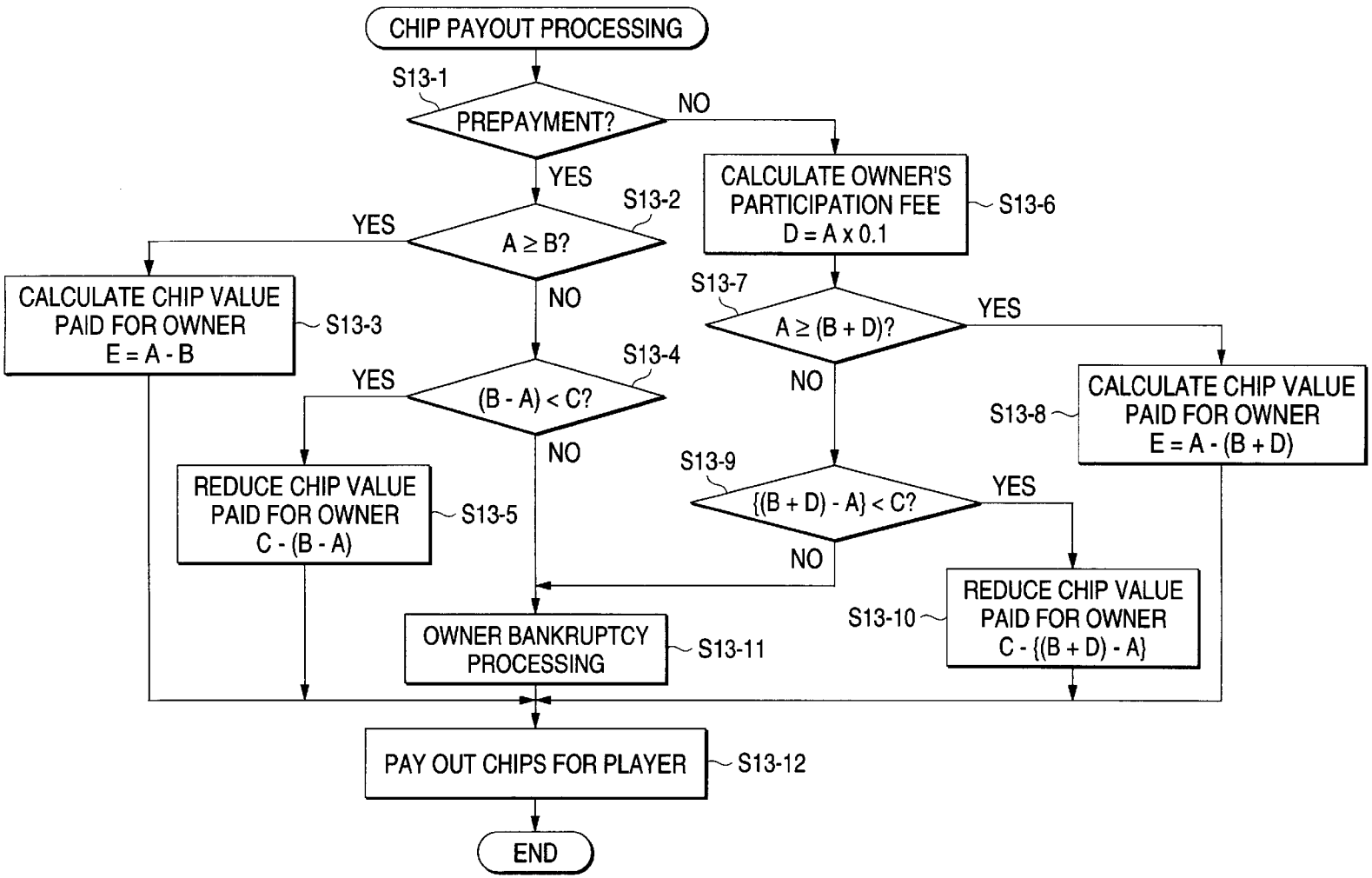
FIG. 8 is a flowchart showing the flow of chip payout processing performed by the game machine.

FIG. 8 is a flowchart showing the flow of chip payout processing. In the drawing, reference symbol A denotes a total amount of chips betted in the layout table 300; B denotes a total amount of chips to be paid to all the players (i.e., a total amount of payout); C denotes a total amount of chips possessed by the owner; D denotes an amount of chips to be paid to an amusement arcade in accordance with a deferred payment; and E denotes the amount of chips acquired by the owner.

In connection with chip payout processing, in step S12 shown in FIG. 7 a determination is made as to whether or not the method of paying chips to an amusement arcade is a prepayment (S13-1). If the method is determined to be a prepayment, the main controller 101 acting as an overpayment determinant determines whether or not the total amount of chips A betted in the layout table 300 is greater than the total amount of chips B to be paid to all the players calculated through payout computation performed in step S12 shown in FIG. 1 (S13-2). Here, if it is determined that $A \geqq B$, the amount of chips E acquired by the owner is determined as A−B (S13-3). Here, if A=B, the amount of chips E acquired by the owner is 0. Hence, no chips are paid to the owner. The amount of chips computed through the payout computation processing (S12) is paid to all the winning players (S13-12).

If in step S13-2 it is determined that A<B, the owner must pay a deficiency in the amount of chips to be paid to the players (i.e., B−A) from his own chips. To this end, a determination is made as to whether or not the deficiency (B−A) in payout is smaller than the total amount of chips C possessed by the owner (S13-4). If it is determined that (B−A)<C or that the deficiency can be covered by the amount of chips possessed by the owner, the deficiency (B−A) is subtracted from the total amount of chips C possessed by the owner (S13-5). More specifically, the main controller 101 sends a predetermined chip subtraction signal to the station controller 201 of the station 10 of the owner. Chip data corresponding to the deficiency (B−A) are subtracted from the chip data stored in the ROM 205. Subsequently, the amount of chips computed through the payout computation processing (S12) is paid to the winning players (S13-12).

If in step S13-1 it is determined that the method of paying chips to an amusement arcade is a deferred payment, an amount determined by multiplying the total amount of chips A betted in the layout table 300 by 10% is computed as the amount of chips D to be paid to the amusement arcade (S12-6). A determination is then made as to whether or not the total amount of chips A betted in the layout table 300 is greater than a sum of the total amount of chips B to be paid to all the winning players and the amount of chips D to be paid to the amusement arcade (S13-7). If it is determined that $A \geqq (B+D)$, the amount of chips E acquired by the owner is determined to be A−(B+D) (S13-8). In the case where A=(B+D), the amount of chips E acquired by the owner is 0; i.e., no chips are paid to the owner. Subsequently, the amount of chips computed through the payout computation processing (S12) is paid to the winning players (S13-12).

In contrast, if in step S13-7 it is determined that A<(B+D), the owner must pay the deficiency [(B+D−A] from his own chips. The main controller 101 acting as the overpayment determinant determines whether or not the deficiency [(B+D)−A] is smaller than the total amount of chips C possessed by the owner (S13-9). If it is determined that [(B+D)−A]<C, or that the deficiency can be covered by the amount determined by subtracting the amount of chips to be paid to the amusement arcade from the amount of chips possessed by the owner, the amount of chips D to be paid to the amusement arcade and the deficiency (B−A) are subtracted from the total amount of chips C possessed by the owner (S13-5). More specifically, a predetermined chip subtraction signal is sent to the station controller 201 of the station 10 of the owner from the main controller 101. Chip amount data corresponding to the deficiency [(B+D)−A] are subtracted from the chip data stored in the RAM 205. Subsequently, the amount of chips computed through the payout computation processing (S12) is paid to the winning players (S13-12).

If in step S13-4 or S13-9 it is determined that $(B-A) \geqq C$ or $[(B+D)-A] \geqq C$, the owner cannot compensate for the deficiency by his own chips and hence will lose all his chips. The owner goes broke, and owner bankruptcy processing is performed (S13-11). Through the owner bankruptcy processing, information about bankruptcy of the owner is sent to the owner and all the players by way of the user displays 11. Further, it is determined the amount of bonus chips to be awarded to the players as a bonus game values. The main controller 101 acting as a bonus presenter pays, to the winning players of the current round of game, chips determined by adding the amount of bonus chips to the amount of payout computed through the payout computation processing (S12). In addition, bonus chips are paid to non-winning players (S13-12).

In the present embodiment, one of the users can enter a game as the owner and can enjoy entertainment unique to the owner, such as conducting bets with players (i.e., the other users) or tossing of a roulette ball. Moreover, if a user participates as the owner, the user accepts higher risks and higher potential returns than when he enters a game as a player, thus enjoying a higher degree of gambling value. Thus, a higher degree of game entertainment can be provided to users.

The present embodiment has described a game machine which provides a roulette game. However, the present invention can also be applied to a game machine of another game involving the owner; for example, a blackjack game, a poker game, or a horserace game. When the present invention is applied to a horserace game machine, there can be provided a novel game in which a user can enter a game as the owner who sponsors a racetrack and provides payout for a horserace.

If the present invention is applied to, e.g., a blackjack game machine, a game proceeds while a user who has declared the owner serves as a dealer. The total points of a hand held by the owner are compared with the total points of a hand held by each of players. A player who has the hand totaling closest to the number 21 becomes a winner. If a player has won the game, the owner pays the same amount of chips as those betted by the player or chips greater in amount than those betted by the player. If the present invention is applied to a blackjack game machine, the owner draws a card, thereby determining a number of points. A game is played by comparing the number of points with the numbers of points of respective players. If the players' points have exceeded the number 21, chips betted by the players are paid to the owner before the number of points of the owner is determined. In contrast with the roulette game described in connection the preceding embodiment, in the blackjack game all the chips to be paid to players are preferably paid from the chips possessed by the owner. As in the case of the game machine set forth, an obligation for paying chips to an amusement arcade may be placed on the owner, even in the case of the blackjack game machine.

In the present embodiment, no difference in the maximum bet a player can bet exists between a case where the owner is involved and a case where no owner is involved. When the owner is involved, the maximum bet may be changed in accordance with the amount of chips possessed by the owner or the owner's wishes. In this case, the maximum amount of payout chips; that is, a case where the highest amount of chips is paid to a player, can be computed through use of predetermined odds. Hence, the main controller 101 or the station controller 201 is operated as an acceptance amount limiter. The maximum bet of each slot may be limited on the basis of the maximum total amount of payout chip in accordance with the total amount of chips possessed by the owner, which is the acceptance requirement. Even when the maximum total amount of payout chips exceeds the total amount of chips possessed by the owner, the owner sends upper limit information about the maximum payout having a desired, additional upper limit added thereto from the station controller 201 to the main controller 101 acting as an upper-limit information receiver, by touching the user panel 12. The upper limit limited by the station controller 201 acting as the acceptance amount limiter may be changed. In this case, when the owner has gone broke, the amusement arcade (i.e., a game machine main unit) must pay chips to players. Hence, if bets for the maximum amount of payout chips betted by a player, which amount exceeds the amount of chips possessed by the owner, are accepted, the amount of chips to be paid to the amusement arcade is preferably made larger than that required at an ordinary time.

The present embodiment has described a roulette game which is played by a plurality of users through use of a single game machine. However, a plurality of arcade game machines are installed in a single amusement arcade or a plurality of amusement arcades, and bidirectional communication is effected among respective game machines. Further, a user who plays a game in a single game machine may play a single roulette game. As a result, there can be embodied a large-scale roulette game involving a larger number of users.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A game machine, comprising:

a game executer, which executes a game in which game values are transferred between an owner and at least one player;

an entry authorizer, which receives a first amount of game values and a player-payout requirement used in the game, from a game participant who wants to be authorized to entry the game as a player;

a player-payout requirement determinant, which judges whether the authorized player satisfies the player-payout requirement;

a player-payout performer, which pays out a second amount of game values to the player who satisfies the player-payout requirement, the second amount of game values being determined in accordance with the first amount of game values and the player-payout requirement;

an owner determinant, which determines the owner from the game participants in accordance with a predetermined owner requirement;

an owner controller operative to enable to the owner to select how to pay chips on the basis of the betting status of all players;

an owner-payout requirement determinant, which enables the owner to select how to pay an owner's participation fee to determine an owner-payout requirement; and an owner-payout performer, which pays out at least a part of a third amount of game values to the owner, in accordance with the owner-payout requirement, the third amount of game values being a total amount of the game values received by the entry authorizer.

2. The game machine as set forth in claim 1, wherein the owner-payout performer pays to the owner a part of a rest amount of game values obtained by subtracting a fourth amount of game values from the third amount of game values, where the fourth amount game values is a total amount of the game values paid by the player-payout performer.

3. The game machine as set forth in claim 1, wherein the player-payout performer pays out the second amount of game values from the third amount of game values.

4. The game machine as set forth in claim 3, further comprising an overpayment determinant which judges the fourth amount of game values exceeds the third amount of game values, wherein the player-payout performer pays out an excess amount of game values from game values possessed by the owner, when the overpayment determinant judges the fourth amount of game values exceeds the third amount of game values.

5. The game machine as set forth in claim 4, further comprising a bonus presenter, which presents bonus game values to the player, when the excess amount of game values exceeds the game values possessed by the owner.

6. The game machine as set forth in claim 4, further comprising an acceptance amount limiter, which delimits an upper limit of the first amount of game values in accordance with a predetermined acceptance requirement.

7. The game machine as set forth in claim 6, further comprising an upper-limit information receiver, which receives an upper limit information issued from the owner for determining the upper limit of the first amount of game values, wherein the acceptance amount limiter utilizes the upper limit information as the acceptance requirement.

8. The game machine as set forth in claim 1, wherein the player-payout performer pays out the second amount of game values from game values possessed by the owner.

9. The game machine as set forth in claim 5, further comprising a bonus presenter, which presents bonus game values to the player, when the second amount of game values exceeds the game values possessed by the owner.

10. The game machine as set forth in claim 5, further comprising an acceptance amount limiter, which delimits an upper limit of the first amount of game values in accordance with a predetermined acceptance requirement.

11. The game machine as set forth in claim 10, further comprising an upper-limit information receiver, which receives an upper limit information issued from the owner for determining the upper limit of the first amount of game values, wherein the acceptance amount limiter utilizes the upper limit information as the acceptance requirement.

12. The game machine as set forth in claim 1, further comprising an owner entry request receiver, which receives an owner entry request issued from a game participant who wants to participate in the game as an owner, wherein the owner determinant determines the owner from at least one game participants who has issued the owner entry request.

13. The game machine as set forth in claim 1, wherein the owner requirement is that a participant who wants to participate the game as an owner has game values not less than a predetermined amount.

14. The game machine as set forth in claim 1, further comprising:

an acceptance termination request receiver, which receives an acceptance termination request from the owner to terminate a period in which the entry authorizer receives the game values from the player; and an acceptance refuser, which refuses to receive the game values from the player, when the acceptance termination request receiver receives the acceptance termination request.

15. A game machine as set forth in claim 1, wherein the owner-payout requirement determinant is operative to select a serve condition for roulette.

16. A game machine as set forth in claim 1, wherein the owner-payout requirement determinant is operative to select a prepayment or deferred payment of an owner's participation fee.

17. A method of performing a game in which game values are transferred between an owner and at least one player, comprising the steps of:

a) inputting a player entry request to a game machine in which the game is executed, the player entry request being issued from a game participant who wants to participate in the game as a player;

b) determining an owner from the game participants in accordance with a predetermined owner requirement;

c) enabling the owner to select how to pay an owner's participation fee to determine an owner-payout requirement;

d) receiving a first amount of game value and a player-payout requirement used in the game from the game participant who has issued the player entry request;

e) executing the game while involving the player participated in the step a) and the owner determined in the step b);

f) judging whether the player satisfies the player-payout requirement, after the step e) is finished;

g) paying out a second amount of game values to the player who satisfies the player-payout requirement the second amount of game values being determined in accordance with the first amount of game values and the player-payout requirement; and h) paying out at least a part of a total amount of the first game values received in the step d) to the owner, in accordance with the owner-payout requirement.

18. The method of claim 15, further comprising selecting a serve condition for roulette.

19. The method of claim 15, wherein a prepayment or a deferred payment of the owner's participation fee is selected.

* * * * *